US008177579B2

(12) United States Patent
Tai et al.

(10) Patent No.: US 8,177,579 B2
(45) Date of Patent: May 15, 2012

(54) POWER RECEPTACLE WITH ENLARGED HEAT DISSIPATION PATH FORMED ON MATING FACE AND POWER CONNECTOR ASSEMBLY THEREOF

(75) Inventors: Hung-Chi Tai, Jhonghe (TW); Kuo-Cheng Liu, Jhonghe (TW); Wang-I Yu, Jhonghe (TW); Yung-Chih Hung, Jhonghe (TW)

(73) Assignee: Alltop Electronics (Suzhou), Ltd., Taicang (CN)

( * ) Notice: Subject to any disclaimer, the term of this patent is extended or adjusted under 35 U.S.C. 154(b) by 0 days.

(21) Appl. No.: 13/233,763

(22) Filed: Sep. 15, 2011

(65) Prior Publication Data

US 2012/0064777 A1 Mar. 15, 2012

Related U.S. Application Data

(63) Continuation of application No. 12/952,800, filed on Nov. 23, 2010, now Pat. No. 8,038,466.

(30) Foreign Application Priority Data

Sep. 13, 2010 (CN) ..... 2010 1 0279501
Sep. 13, 2010 (CN) ..... 2010 1 0279503

(51) Int. Cl.
*H01R 4/60* (2006.01)

(52) U.S. Cl. ..... 439/485; 439/206

(58) Field of Classification Search ..... 439/485, 439/206
See application file for complete search history.

(56) References Cited

U.S. PATENT DOCUMENTS

| | | | | |
|---|---|---|---|---|
| 6,994,598 | B2 | 2/2006 | Holmes et al. | |
| 7,059,919 | B2 | 6/2006 | Clark et al. | |
| 7,597,573 | B2 * | 10/2009 | Defibaugh et al. | 439/206 |
| 7,666,025 | B2 | 2/2010 | Cheng et al. | |
| 7,690,937 | B2 | 4/2010 | Daily et al. | |
| 7,857,656 | B2 | 12/2010 | Tai et al. | |
| 7,938,675 | B1 | 5/2011 | Yu et al. | |
| 8,043,112 | B2 * | 10/2011 | Filipon et al. | 439/485 |
| 2008/0207029 | A1 | 8/2008 | Defibaugh et al. | |
| 2010/0048056 | A1 | 2/2010 | Daily et al. | |
| 2011/0076871 | A1 * | 3/2011 | Yu et al. | 439/345 |
| 2011/0287658 | A1 * | 11/2011 | Yu et al. | 439/485 |

* cited by examiner

*Primary Examiner* — Gary F. Paumen
(74) *Attorney, Agent, or Firm* — Sughrue Mion, PLLC

(57) ABSTRACT

A power receptacle includes an insulative housing and a number of power contacts received in the insulative housing. The insulative housing has a base extending along a first direction and a mating portion protruding from the base. The mating portion has a first mating surface, a pair of side surfaces extending perpendicularly to the first mating surface, and a first slot recessed into the mating portion from the first mating surface. The first slot extends through the pair of side surfaces of the mating portion along the first direction. The insulative housing includes a first mounting surface opposite to the first mating surface and defines a first through hole extending therethrough which is exposed to the outside from the first mating surface.

20 Claims, 14 Drawing Sheets

POWER RECEPTACLE WITH ENLARGED HEAT DISSIPATION PATH FORMED ON MATING FACE AND POWER CONNECTOR ASSEMBLY THEREOF

CROSS-REFERENCE TO RELATED APPLICATION

This application is a Continuation Application of U.S. patent application Ser. No. 12/952,800, filed Nov. 23, 2010, and entitled "POWER RECEPTACLE WITH ENLARGED HEAT DISSIPATION PATH FORMED ON MATING FACE AND POWER CONNECTOR ASSEMBLY THEREOF", which has the same assignee as the present invention and which is incorporated herein by reference in its entirety.

BACKGROUND OF THE INVENTION

1. Field of the Invention

The present invention relates to a power receptacle and a power connector assembly thereof, and more particularly to a power receptacle and a power connector assembly thereof with enlarged heat dissipation path formed on a mating surface.

2. Description of Related Art

Mateable power receptacle and power plug are commonly used for power transmission. It is known that heat is generated by impedance of power contacts during power transmission. Nowadays, more and more electronic devices need heavy power to work, and power connector assemblies which can endure high current are accordingly needed. Heat dissipation becomes one of the most annoying problems in connector design. If the heat is limited in insulative housings of the power connector assembly, and cannot be eliminated timely, the insulative housings might be burnt. Besides, mateable contact portions of contacts of the power connector assembly might melt. The high temperature once monitored by the client-side will crash the electronic devices. Bad heat dissipation may result in security problems for the worse.

U.S. Pat. No. 6,994,598 B2 issued to Holmes et al. on Feb. 7, 2006 discloses a traditional power connector assembly. The power connector assembly includes a male connector and a female connector both provided with multiple power contacts retained in an insulative housing. However, such power contacts are closed in the insulative housings when the male connector and the female connector are mated with each other for power transmission. As a result, heat dissipation thereof is poor.

Hence, a power receptacle and a power connector assembly thereof with improved heat dissipation path are needed to solve the above problem.

BRIEF SUMMARY OF THE INVENTION

The present invention provides a power connector assembly including a power receptacle and a power plug for mating with the power receptacle. The power receptacle includes a first insulative housing and a plurality of receptacle power contacts received in the first insulative housing. The first insulative housing includes a base and a mating portion protruding from the base along a first direction. The mating portion comprises a first mating surface for mating with the power plug, an upper surface, a lower surface and a first slot recessed into the mating portion from the first mating surface. The first slot extends through at least one of the upper and the lower surfaces of the mating portion along a second direction perpendicular to the first direction. The base has a first mounting surface opposite to the first mating surface. The insulative housing further defines a first through hole throughout the first mounting surface to be exposed to an exterior. The first through hole is in communication with the first slot in order to form a heat dissipation path for eliminating heat generated by the receptacle power contacts.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 10 is a partly exploded view of the power plug as shown in

FIG. 9;

DETAILED DESCRIPTION OF THE PREFERRED EMBODIMENTS

Figure 1:
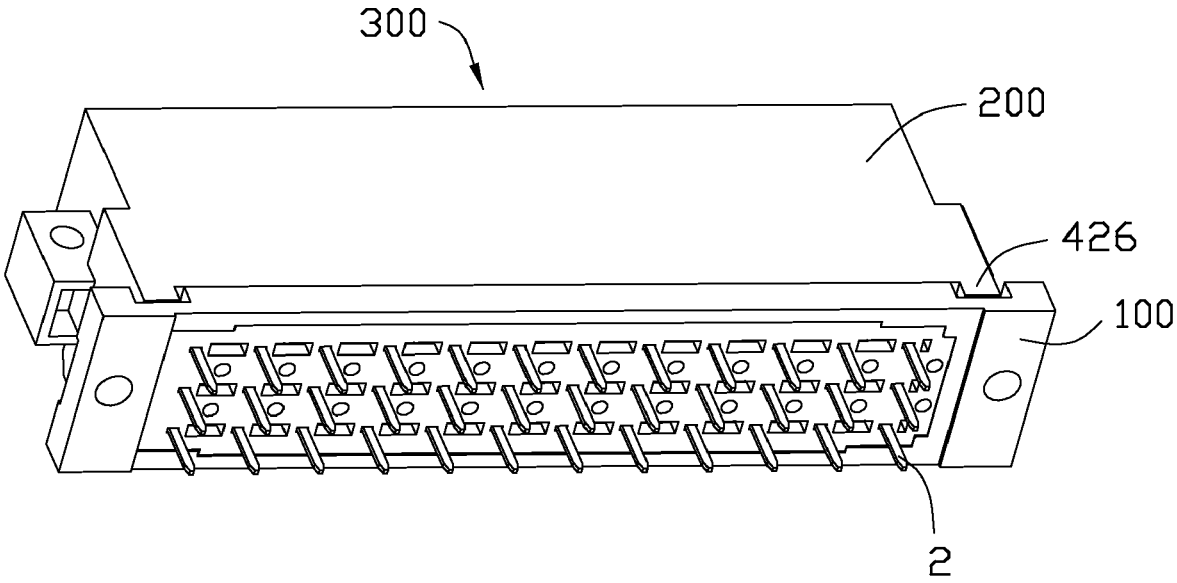
FIG. 1 is a perspective view of a power connector assembly in accordance with an embodiment of the present invention.

Reference will now be made to the drawing figures to describe the embodiments of the present invention in detail. In the following description, the same drawing reference numerals are used for the same elements in different drawings.

Figure 2:
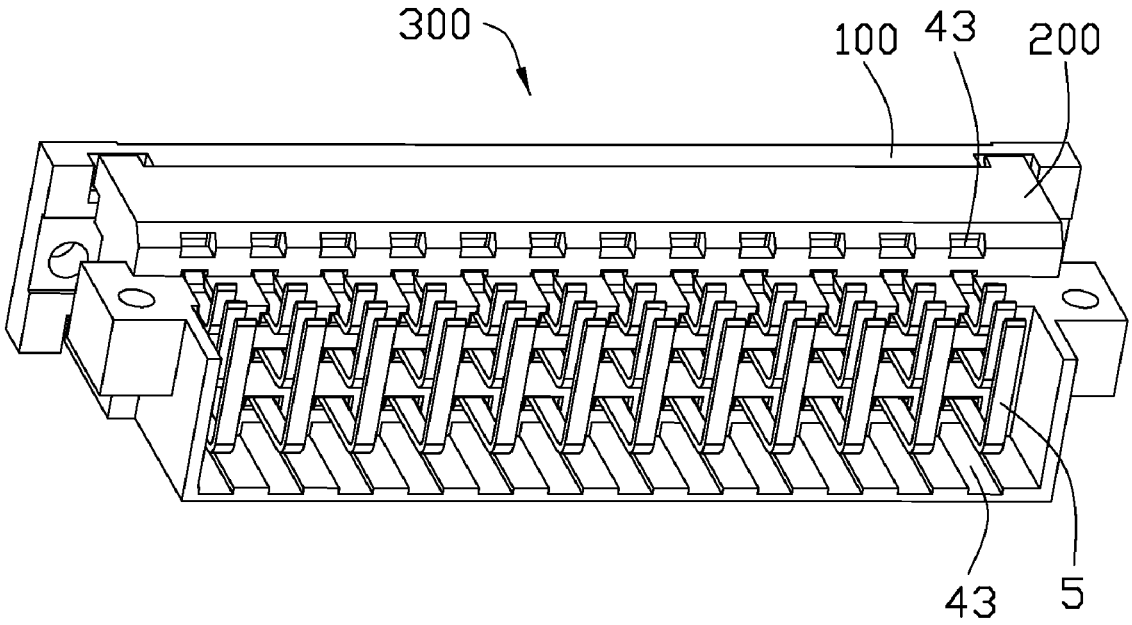
FIG. 2 is a perspective view of the power connector assembly similar to FIG. 1, but taken from another aspect.
Figure 3:
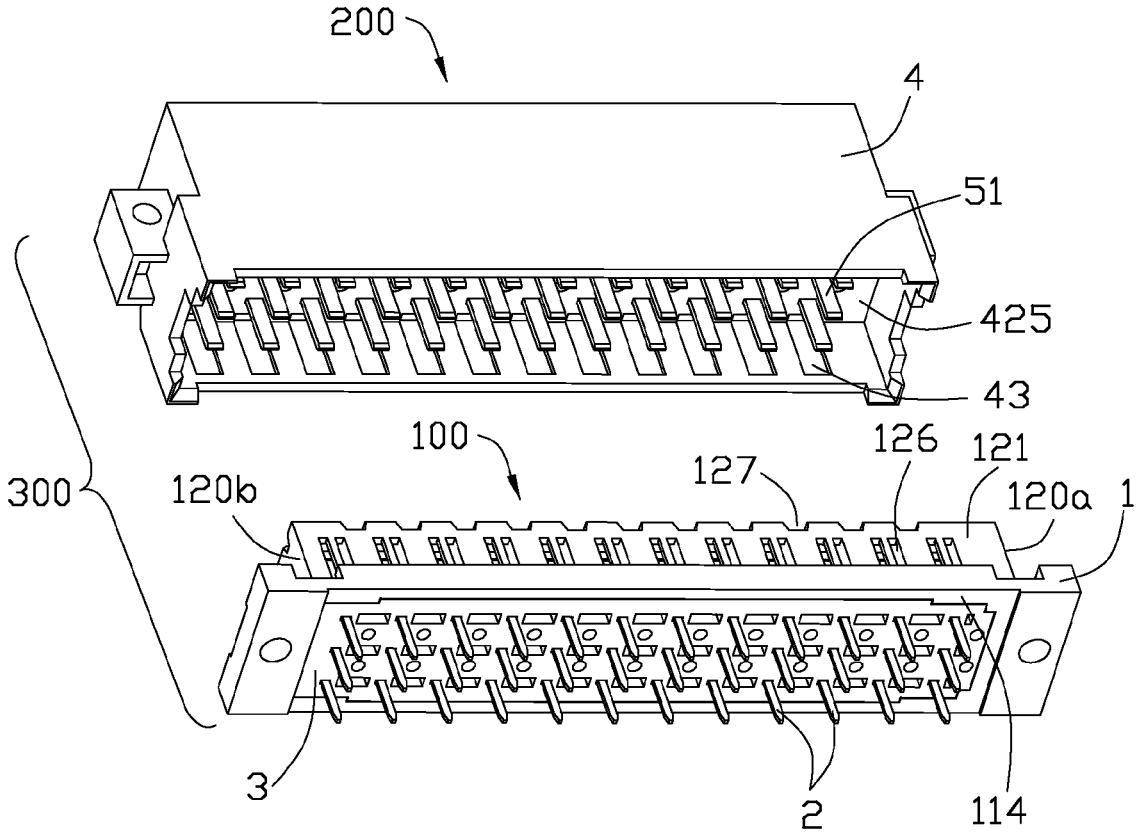
FIG. 3 is an exploded view of a power connector assembly with a power receptacle separated from a power plug.

Referring to FIGS. 1 to 3, a power connector assembly 300 according to an embodiment of the present invention includes a power receptacle 100 and a power plug 200 mateable with the power receptacle 100 for power transmission.

Referring to FIGS. 3 to 7, the power receptacle 100 includes a receptacle insulative housing 1, a plurality of receptacle power contacts 2 received in the insulative housing 1, and an organizer 3 mounted to the insulative housing 1 for organizing the receptacle contacts 2.

The insulative housing 1 includes a base 11 and a mating portion 12 protruding from a front surface 113 of the base 11 along a first direction. The base 11 includes a top wall 111, a bottom wall 112 and a first mounting surface 114 opposite to the front surface 113. Besides, the base 11 further defines a plurality of positioning depressions 115 recessed from the front surface 113 for guiding insertion of the power plug 200, and a mounting depression 116 recessed from the first mounting surface 114 for receiving the organizer 3. The mating portion 12 is contractive with respect to the base 11 and includes an upper surface 121, a lower surface 122, a first side surface 120*a*, a second side surface 120*b* and a first mating surface 123. The first and the second side surfaces 120*a*, 120*b* are perpendicular to the upper and the lower surfaces 121, 122. The first mating surface 123 is parallel to the first mounting surface 114 and is perpendicular to the first and the second side surfaces 120*a*, 120*b* and the upper and the lower surfaces 121, 122. The top wall 111 and the bottom wall 112 are located outside of the upper surface 121 and the lower surface 122 along a vertical direction, respectively.

The insulative housing 1 further includes a plurality of contact passageways 124 extending along the first direction for receiving the receptacle power contacts 2. Besides, a plurality of first through holes 125 are defined through the first mounting surface 114 to be exposed an exterior. The first through holes 125 are parallel to the contact passageways 124. The first through holes 125 are round according to the illustrated embodiment of the present invention. However, it is easy to be understood that the first through holes 125 can be of other shapes such as rectangle, ellipse etc.

Figure 4:
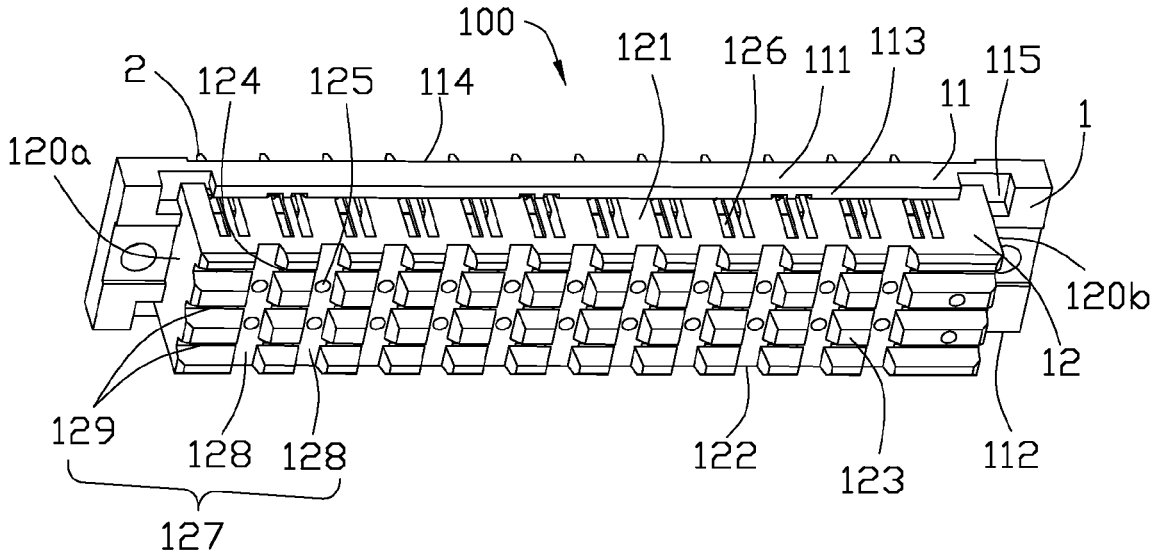
FIG. 4 is a perspective view of the power receptacle.

Referring to FIGS. 3 and 4, according to the preferred embodiment of the present invention, both the upper surface 121 and the lower surface 122 define a plurality of first heat dissipation passageways 126 in communication with the corresponding contact passageways 124. Alternatively, the first heat dissipation passageways 126 can be selectively formed on the upper surface 121 and the lower surface 122. Each first heat dissipation passageway 126 extends along the first direction and further extends through the first mounting surface 114 along the first direction to be exposed to the exterior. Each first heat dissipation passageway 126 is further recessed into the base 11 along the vertical direction in order to enlarge the dimension thereof for robust heat dissipation effect. The first heat dissipation passageways 126 formed on the upper surface 121 are aligned with the corresponding first heat dissipation passageways 126 formed on the lower surface 122 along the vertical direction. As shown in FIG. 4, the first heat dissipation passageways 126 do not extend throughout the first mating surface 123 in order to in order to ensure the intensity of the insulative housing 1 for assembling the receptacle power contacts 2.

Figure 5:
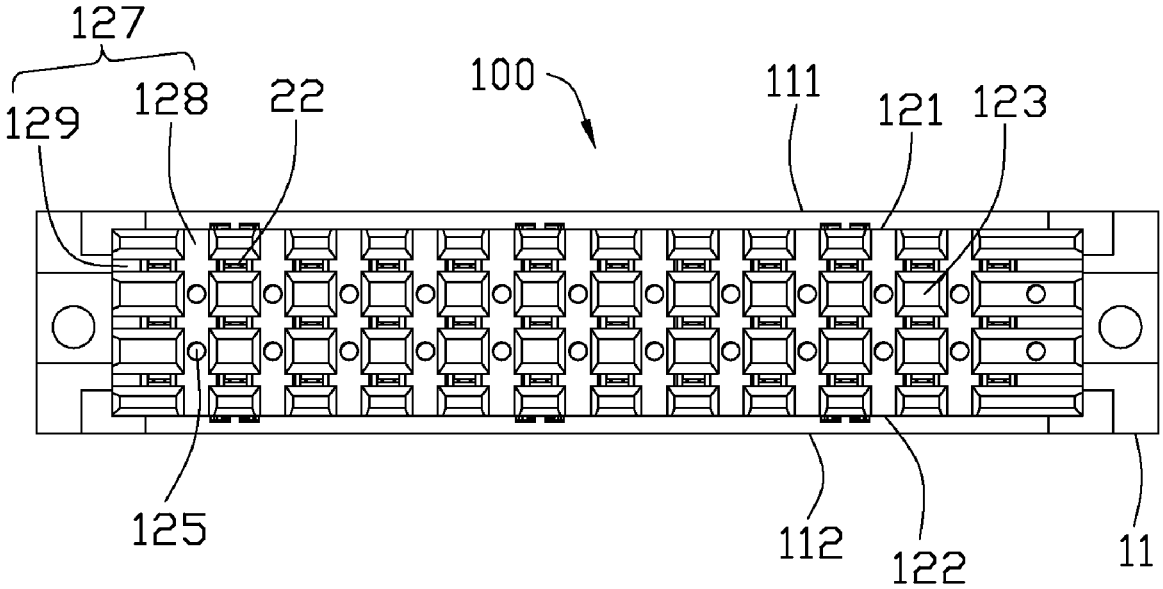
FIG. 5 is a front view of the power receptacle as shown in FIG. 4.
Figure 6:
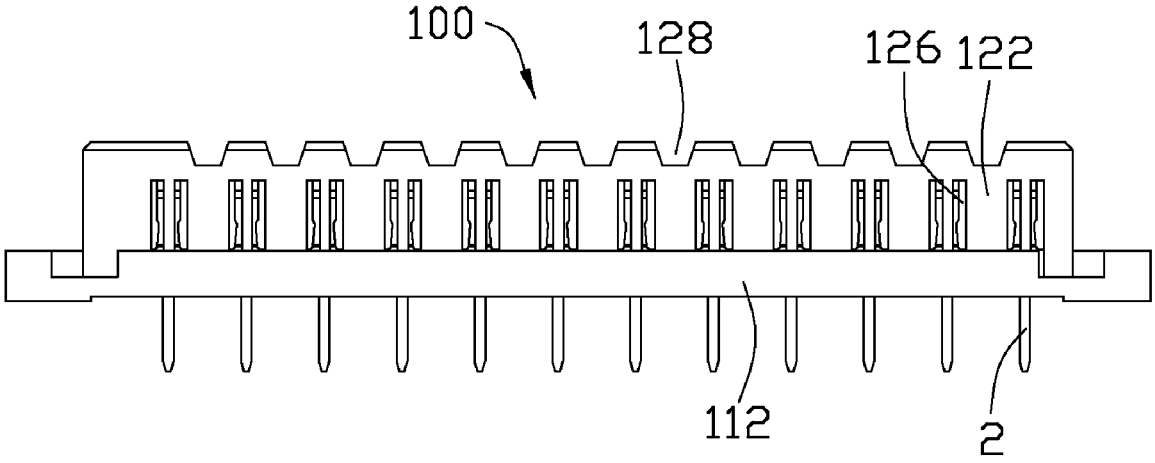
FIG. 6 is a bottom view of the power receptacle as shown in FIG. 4.

As shown in FIGS. 4 and 5, the mating portion 12 defines a plurality of slots 127 recessed into the mating portion 12 from the first mating surface 123. The slots 127 include a plurality of first slots 128 and a plurality of second slots 129 intersecting the first slots 128. The first slots 128 are narrow in width and extend along the vertical direction perpendicular to the first direction. The second slots 129 extend along a horizontal direction perpendicular to the first direction as well. Besides, the first and the second slots 128, 129 are crossed and in communication with each other. According to the illustrated embodiment of the present invention, the first slots 128 extend through both the upper and the lower surfaces 121, 122, and the second slots 129 extend through both the first and the second side surfaces 120*a*, 120*b*. Alternatively, the first slots 128 extend through at least one of the upper and the lower surfaces 121, 122, and the second slots 129 extend through at one of the first and the second side surfaces 120*a*, 120*b*.

As shown in FIGS. 4 to 7, the first through holes 125 are in communication with the corresponding first slots 128 along the first direction. Since the first slots 128 extend forwardly through the first mating surface 123, and the first through holes 125 extend backwardly through the first mounting surface 114, the first slots 128 and the first through holes 125 jointly form a first heat dissipation path for dissipating the receptacle power contacts 2. Besides, heat generated by the receptacle power contacts 2 can also be dissipated via a second heat dissipation path formed by the first slots 128 and the first heat dissipation passageways 126.

Figure 7:
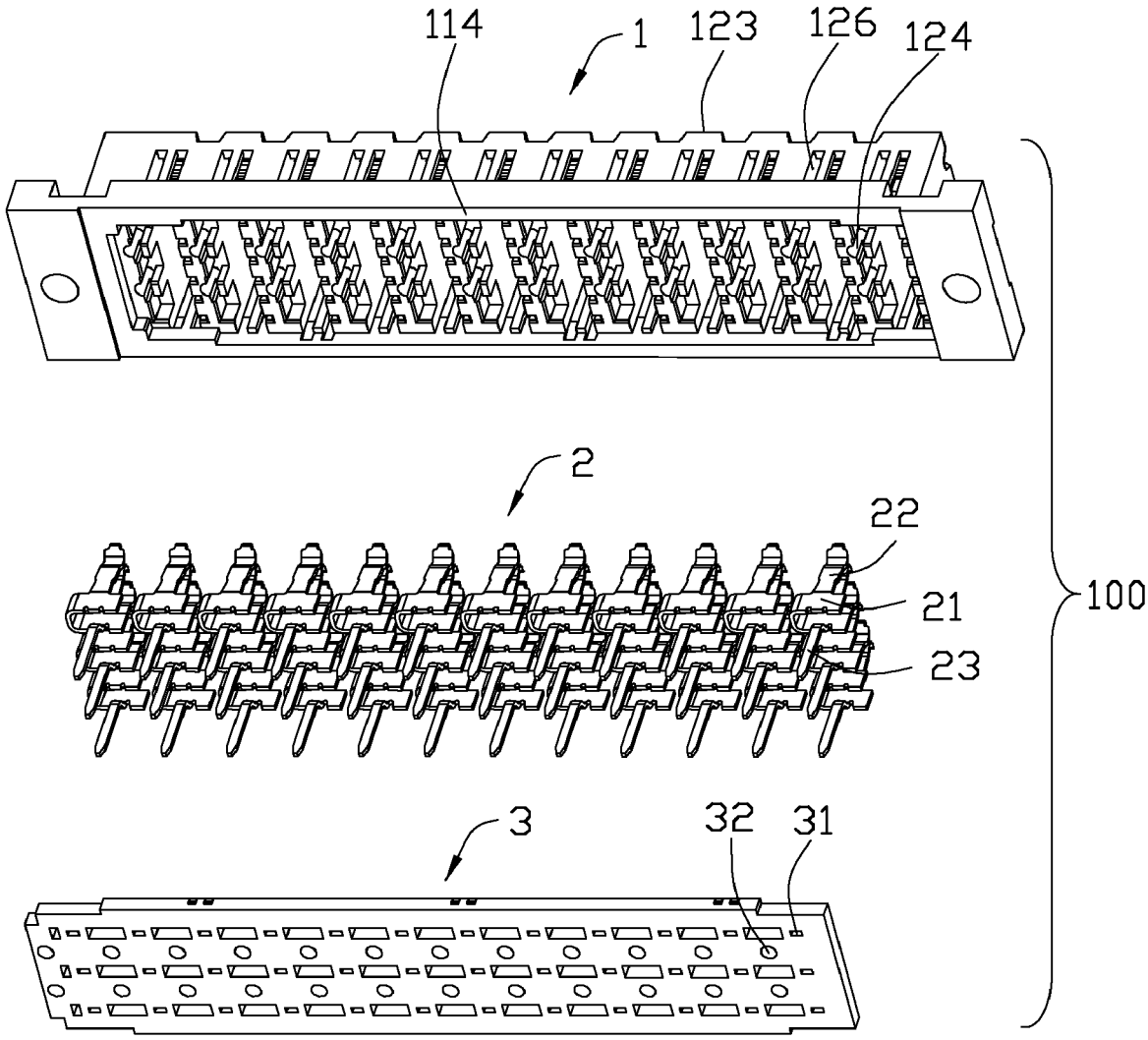
FIG. 7 is an exploded view of the power receptacle as shown in FIG. 4.

As shown in FIG. 7, each receptacle power contact 2 includes a U-shaped retaining portion 21, a pair of elastic contacting arms 22 extending forwardly from opposite upper and lower sides of the retaining portion 21, and a first mounting portion 23 extending backwardly from the retaining portion 21. The contacting arms 22 reside in the corresponding contact passageways 124 and do not extend beyond the first mating surface 123. The first mounting portions 23 extend beyond the first mounting surface 114 for being soldered to a PCB.

The organizer 3 is rectangular and defines a plurality of positioning holes 31 for the first mounting portions 23 of the receptacle power contacts 2 extending therethrough, and a plurality of heat dissipation holes 32 aligned with the corresponding first through holes 125.

Figure 8:
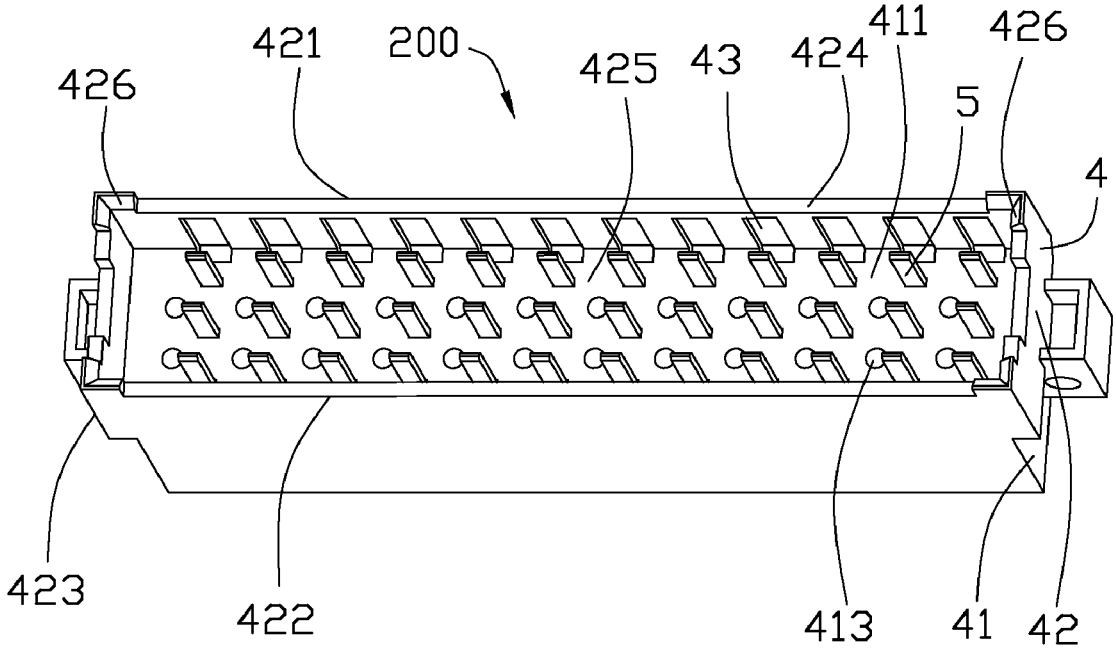
FIG. 8 is a perspective view of the power plug.
Figure 9:
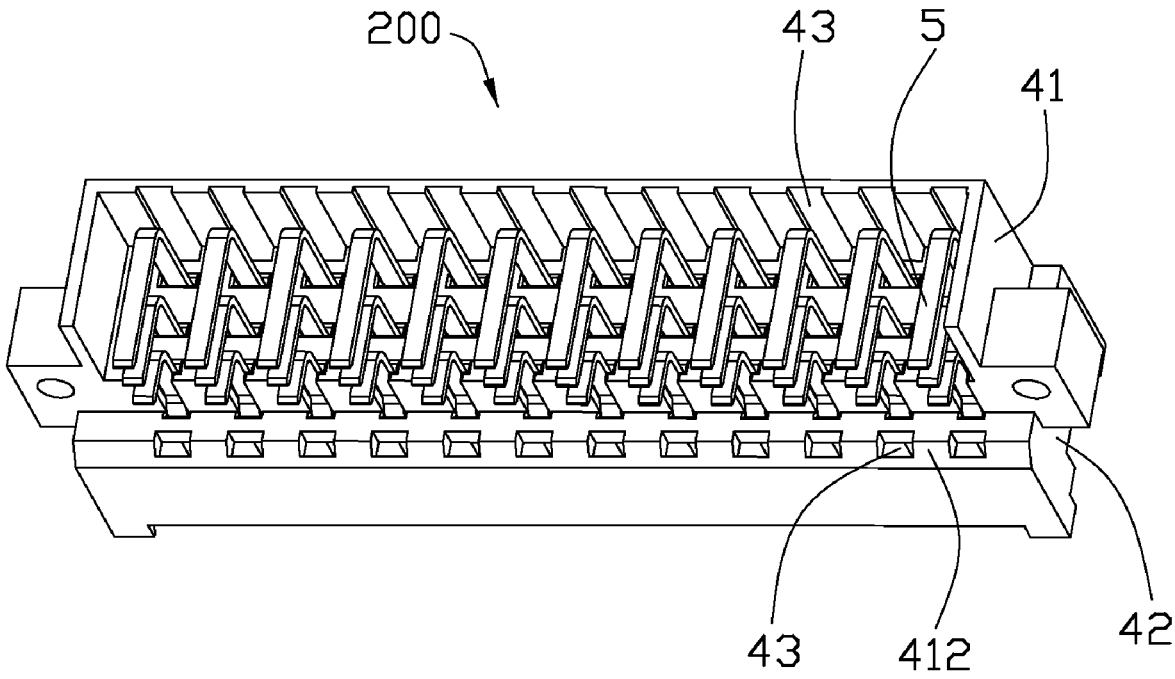
FIG. 9 is another perspective view of the power plug as shown in FIG. 8, but taken from a different aspect.
Figure 10:
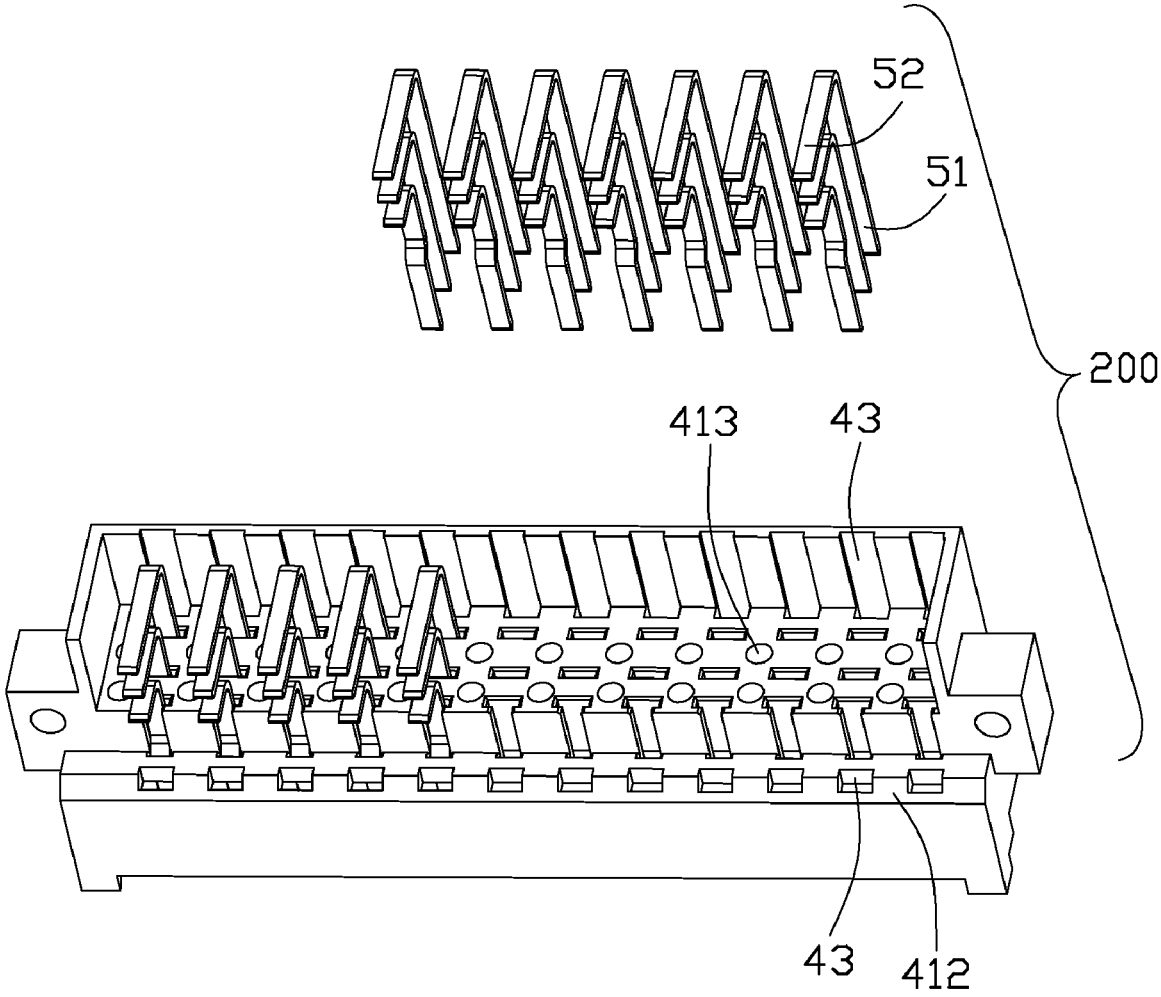
Figure 11:
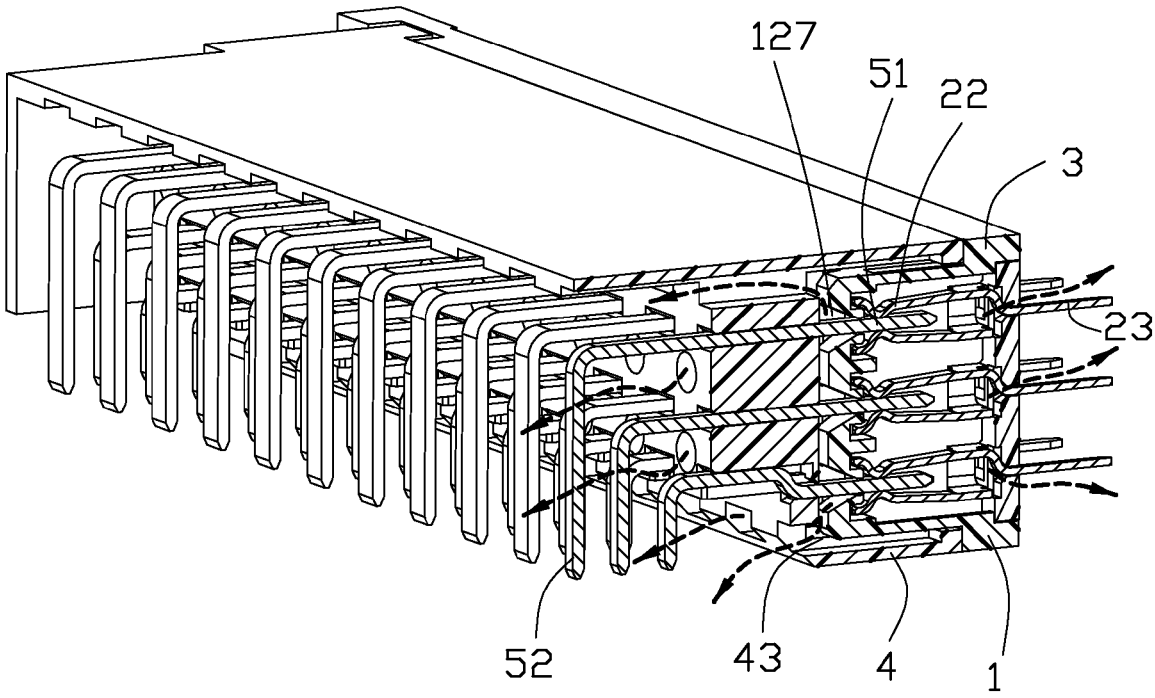
FIG. 11 is a cross-sectional view of the power connector assembly taken along a first cross section.

As shown in FIGS. 8 and 10, the power plug 200 includes a plug insulative housing 4 and a plurality of plug power contacts 5 fixed to the insulative housing 4. The insulative housing 4 includes a base portion 41 and a mating portion 42 protruding from the base portion 41 along the first direction. The mating portion 42 includes a top wall 421, a bottom wall 422, a pair of side walls 423 connecting the top wall 421 and the bottom wall 422, a second mating surface 424 perpendicular to the top wall 421 and the bottom wall 422, and a receiving chamber 425 recessed from the second mating surface 424. The base portion 41 includes a front surface 411 exposed to the receiving chamber 425, a second mounting surface 412 opposite to the front surface 411, and a plurality of second through holes 413 extending through the front surface 411 and the second mounting surface 412. Each second through hole 413 is of the same configuration of the first through holes 125 and is aligned with the corresponding first through holes 125 along the first direction.

Referring to FIGS. 8 and 10, according to the embodiment of the present invention, inner sides of both the top wall 421 and the bottom wall 422 define a plurality of second heat dissipation passageways 43 in communication with the receiving chamber 425. Alternatively, the second heat dissipation passageways 43 can be selectively formed on the inner side of the top wall 421 and the bottom wall 422. Each second heat dissipation passageway 43 linearly extend through the second mounting surface 412 to be exposed to the exterior. Besides, the second heat dissipation passageways 43 are further recessed into the base portion 41 along the vertical direction in order to enlarge the dimensions thereof.

The insulative housing 4 includes a plurality of protrusions 426 extending beyond the second mating surface 424 for mating with the positioning depressions 115 of the power receptacle 1.

As shown in FIG. 10, each plug power contact 5 includes a flat second contacting portion 51 extending into the receiving chamber 425, and a second mounting portion 52 extending through the second mounting surface 412.

Figure 12:
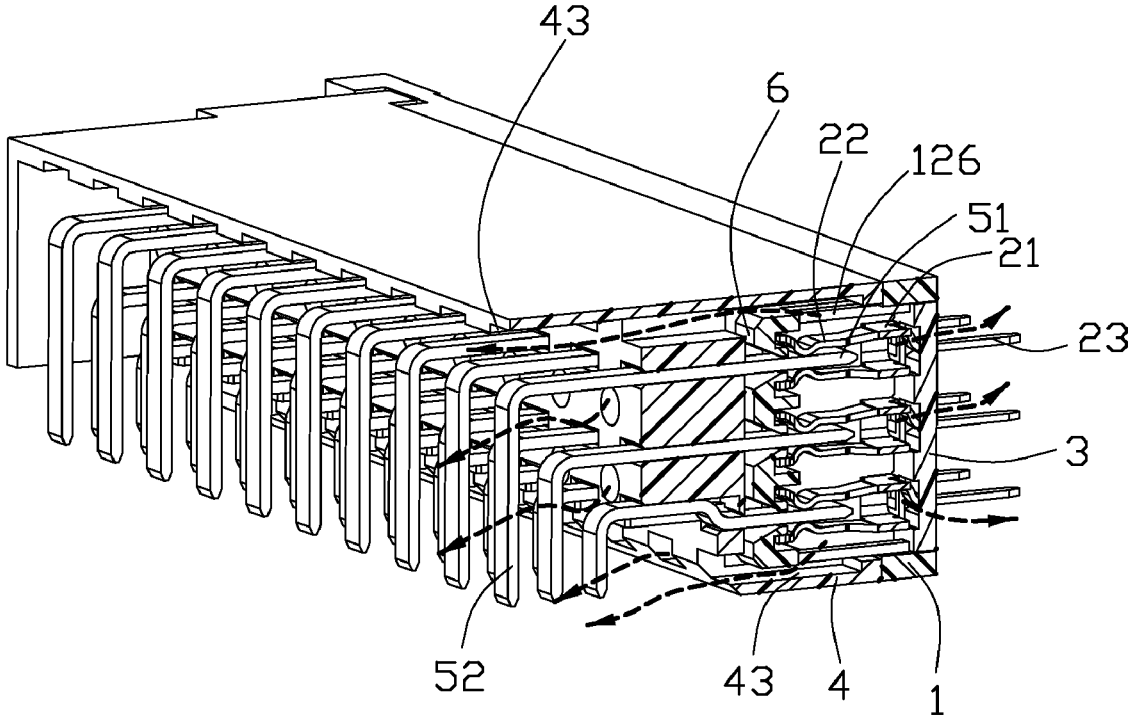
FIG. 12 is a cross-sectional view of the power connector assembly taken along a second cross section.
Figure 13:
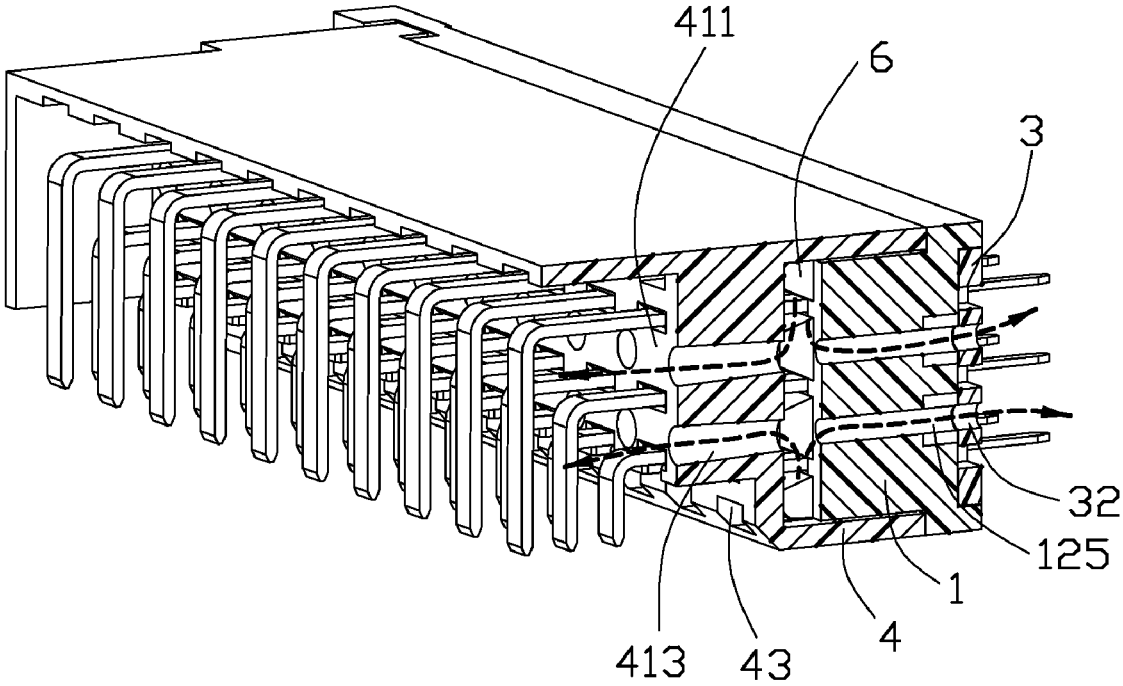
FIG. 13 is a cross-sectional view of the power connector assembly taken along a third cross section.
Figure 14:
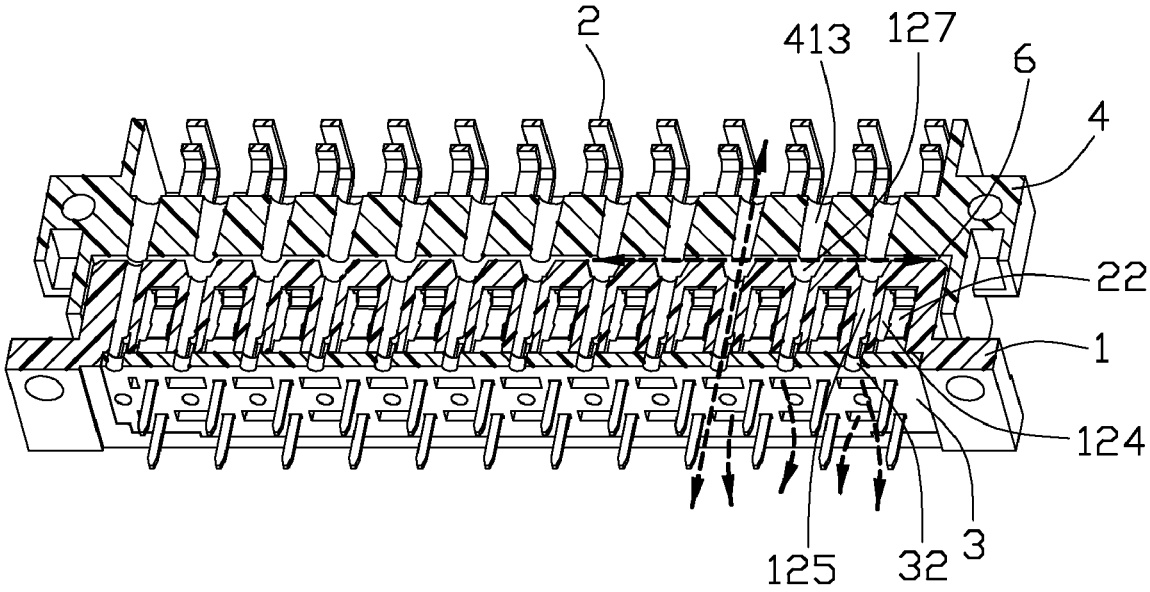
FIG. 14 is a cross-sectional view of the power connector assembly taken along a fourth cross section.

As shown in FIGS. 11 to 14, when the power receptacle 100 is fully received in the receiving chamber 425 of the power plug 200, each second contacting portion 51 is clipped by the first contacting arms 22. Since most heat generated by the power receptacle contacts 2 and the plug power contacts 5 occurs nearby the contacting areas, the heat can be dissipated via the first and the second heat dissipation passageways 126, 43 which are exposed to the exterior through the first and the second mounting surfaces 114, 412 along the first direction. Besides, the heat can also be dissipated to the exterior via the first and the second slots 128, 129 together with the first and the second through holes 125, 413 which are exposed to the exterior through the first and the second mounting surfaces 114, 412. As shown in FIG. 12, within a length of the receiving chamber 425 along the first direction, the second heat dissipation passageways 43 are located over the first heat dissipation passageways 126. As shown in FIGS. 13 and 14, the first mating surface 123 of the power receptacle 100 is spaced a distance from the front surface 411 of the power plug 200 in order to form an inner heat dissipation channel 6 which is in communication with the first and the second slots 128, 129. As shown in FIGS. 11 to 14, under this arrangement, robust airflow occurs through the inner heat dissipation channel 6 to expedite heat dissipation. Moreover, the first through holes 125 are aligned and in communication with the second through holes 413 along the first direction for heat dissipation as well. As a result, both the receptacle insulative housing 1 and the plug insulative housing 4 can be prevented from being burnt and unrecoverable high deformation, as well as the power receptacle contacts 2 and the plug power contacts 5. Besides, when the inner dissipation channel 6 is narrow, flowing heat in the first and the second heat dissipation passageways 126, 43 can enter into the first and the second through holes 125, 413 to be ultimately dissipated to the exterior, via the first slots 128.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A power receptacle comprising:

an insulative housing comprising a base extending along a first direction and a mating portion protruding from the base, the mating portion comprising a first mating surface for mating with a complementary connector, a pair of side surfaces extending perpendicularly to the first mating surface, and a first slot recessed into the mating portion from the first mating surface, the first slot extending through at least one of the pair of side surfaces of the mating portion along the first direction, the base comprising a first mounting surface opposite to the first mating surface; and a plurality of receptacle power contacts received in the insulative housing;

wherein the insulative housing defines a first through hole extending therethrough and exposed to the outside from the first mating surface, the first through hole not having a power contact therein.

2. The power receptacle as claimed in claim 1, wherein the first slot extends through both the pair of side surfaces.

3. The power receptacle as claimed in claim 1, wherein the first slot extends along a horizontal direction.

4. The power receptacle as claimed in claim 3, wherein the mating portion comprises opposite upper surface and lower surface, and wherein the first slot extends parallel to the upper surface and the lower surface.

5. The power receptacle as claimed in claim 1, wherein the insulative housing provides a first mounting surface opposite to the first mating surface.

6. The power receptacle as claimed in claim 5, wherein the insulative housing defines a plurality of contact passageways in communication with the first slot in order to receive the receptacle power contacts, each receptacle power contact comprising a pair of contacting arms residing in the corresponding contact passageways and a mounting portion extending beyond the first mounting surface.

7. The power receptacle as claimed in claim 1, wherein the insulative housing defines a plurality of first heat dissipation passageways extending through the upper and the lower surfaces of the mating portion, the first heat dissipation passageways being in communication with the receptacle power contacts and further extending throughout the first mounting surface.

8. A power connector assembly comprising:

a power receptacle and a power plug mateable with each other, the power receptacle comprising:

a first insulative housing comprising a mating portion, a first mounting surface opposite to the mating portion, and a plurality of contact passageways, the mating portion comprising a first mating surface for mating with the power plug, a pair of first side surfaces; and a plurality of receptacle power contacts received in the contact passageways;

the power plug comprising:

a second insulative housing comprising a second mating surface, a second mounting surface and a receiving chamber recessed from the second mating surface to accommodate the mating portion of the first insulative housing; and a plurality of plug power contacts fixed to the second insulative housing for abutting against the receptacle power contacts;

wherein the mating portion of the first insulative housing defines a plurality of first slots recessed from the first mating surface and extending through at least one of the pair of first side surfaces of the mating portion, the first slots being in communication with the corresponding contact passageways;

wherein the first insulative housing defines a plurality of first through holes extending therethrough and the second insulative housing defines a plurality of second through holes aligned with and in communication with the plurality of first through holes, and wherein heat generated by the receptacle power contact and the plug power contact can be dissipated to the exterior through the first and the second through holes together with the first slot.

9. The power connector assembly as claimed in claim 8, wherein each receptacle power contact comprises a pair of contacting arms residing in the corresponding contact passageway, and each plug power contact comprises a flat contacting portion clipped by the contacting arms.

10. The power connector assembly as claimed in claim 8, wherein the second through holes are communicating with the receiving chamber and further extending through the second mounting surface to be exposed to the exterior.

11. The power connector assembly as claimed in claim 8, wherein both the first through holes and the second through holes are arranged between columns of receptacle power contacts and columns of plug power contacts.

12. The power connector assembly as claimed in claim 11, wherein the second insulative housing comprises a front surface exposed to the receiving chamber into which the plug power contacts protrude; and wherein when the first insulative housing is fully received in the receiving chamber of the second insulative housing, the first mating surface and the front surface are spaced a distance from each other.

13. A power connector assembly comprising:

a first power connector and a second power connector engaging with the first power connector, each of the power connectors having an insulative housing and a plurality of contacts retained in corresponding contact passageways of corresponding insulative housing, the plurality of contacts being arranged in columns, the insulative housing of the first power connector providing a mating portion, the insulative housing of the second power connector providing a receiving chamber receiving the mating portion, the receiving chamber being defined by side walls of the insulative housing of the second power connector;

wherein at least two heat dissipation ways are provided surrounding the columns of contacts of engaged first and second power connectors;

wherein a dissipation direction of one of the at least two heat dissipation ways is along a first direction same to a mating direction of the first and the second power connectors, and the dissipation direction of the other one of the at least two heat dissipation ways is along a second direction perpendicular to the first direction.

14. The power connector as claimed in claim 13, wherein the insulative housing of the first power connector defines a plurality of first through holes between columns of contacts, and wherein the insulative housing of the second power connector defines a plurality of second through holes between columns of contacts, and wherein the first through holes and the second through holes are aligned and communicating with each other.

15. The power connector as claimed in claim 14, wherein the one of the at least two dissipation ways is formed by the first through hole and the aligned second through hole.

16. The power connector assembly as claimed in claim 13, wherein the insulative housing of the first power connector provides an upper surface and a lower surface with the columns of the contacts being positioned therebetween.

17. The power connector assembly as claimed in claim 16, wherein at least one of the upper surface and the lower surface of the first power connector defines a plurality of dissipation passageways communicating with adjacent column of contact passageways.

18. The power connector assembly as claimed in claim 17, wherein the other one of the at least two dissipation ways is formed by the dissipation passageway and corresponding column of contact passageways.

19. The power connector assembly as claimed in claim 16, wherein a heat dissipation slot is defined between the upper and/or the lower surface of the first power connector and the side wall of the mated second power connector.

20. The power connector assembly as claimed in claim 13, wherein the insulative housing of the second power connector comprises a front surface exposed to the receiving chamber into which the contacts protrude; wherein the insulative housing of the first power connector forms a mating surface; and wherein when the insulative housing of the first power connector is fully received in the receiving chamber of the insulative housing of the second power connector, the first mating surface and the front surface are spaced a distance from each other which facilitates the heat dissipating.

* * * * *